US007104195B2

(12) United States Patent
Johner et al.

(10) Patent No.: US 7,104,195 B2
(45) Date of Patent: Sep. 12, 2006

(54) PACKING FOR A SHEET-GUIDING CYLINDER IN A PROCESSING MACHINE

(75) Inventors: Gerhard Johner, Gelnhausen-Meerholz (DE); Markus Kirst, Büttelborn (DE); Ruth Kremer, Steinbach (DE); Uwe Wilms, Schoneberg (DE); Rainer Schneider, Lorch (DE)

(73) Assignees: MAN Roland Druckmaschinen AG, Offenbach (DE); Coatec Gesellschaft für Oberflächenveredelung GmbH & Co., Schlüchtern (DE)

( * ) Notice: Subject to any disclaimer, the term of this patent is extended or adjusted under 35 U.S.C. 154(b) by 428 days.

(21) Appl. No.: 10/694,031

(22) Filed: Oct. 27, 2003

(65) Prior Publication Data

US 2006/0169155 A1 Aug. 3, 2006

(51) Int. Cl.
*B41F 13/24* (2006.01)
*B41F 5/16* (2006.01)

(52) U.S. Cl. ..... 101/232; 101/174; 101/416.1

(58) Field of Classification Search ..... None
See application file for complete search history.

(56) References Cited

U.S. PATENT DOCUMENTS 4,327,135 A * 4/1982 Wirz et al. ..... 428/600
4,402,267 A * 9/1983 DeMoore ..... 101/419
5,397,651 A * 3/1995 Wirz ..... 428/600
6,073,556 A 6/2000 DeMoore et al.
6,514,623 B1 * 2/2003 Endisch et al. ..... 428/447

FOREIGN PATENT DOCUMENTS

DE 2820549 * 1/1979
DE 2914255 * 4/1979
DE 4230567 A1 3/1994
EP 0017776 A1 3/1980
EP 0999043 B1 10/1999

OTHER PUBLICATIONS

*Internationaler Recherchenbericht*, dated Sep. 24, 2002, 5 pages.

* cited by examiner

*Primary Examiner*—Daniel J. Colilla
*Assistant Examiner*—Marissa Ferguson-Samreth
(74) *Attorney, Agent, or Firm*—Leydig, Voit & Mayer, Ltd

(57) ABSTRACT

A printing and/or varnishing machine having a plurality of sheet-guiding cylinders in which at least one of the cylinders has an outer detachable packing which has enhanced ink repellent characteristics and which significantly reduces wear. The packing has a layered structure which includes a flexible backing material 12, the underside of which is assigned to the base body of the sheet-guiding cylinder 3, a coating 13 of molybdenum or tungsten carbide/cobalt which is adhesively applied to the upper side of the backing material 12, and a sealing layer 14 of a material made from the group of polysiloxanes which is adhesively applied to the upper side of the coating 13. The side of the packings 5, 6 which faces the material to be printed has a surface profile consisting of cones 18 with rounded tips 16 for reduced sheet contact.

12 Claims, 3 Drawing Sheets

PACKING FOR A SHEET-GUIDING CYLINDER IN A PROCESSING MACHINE

Figure 1:
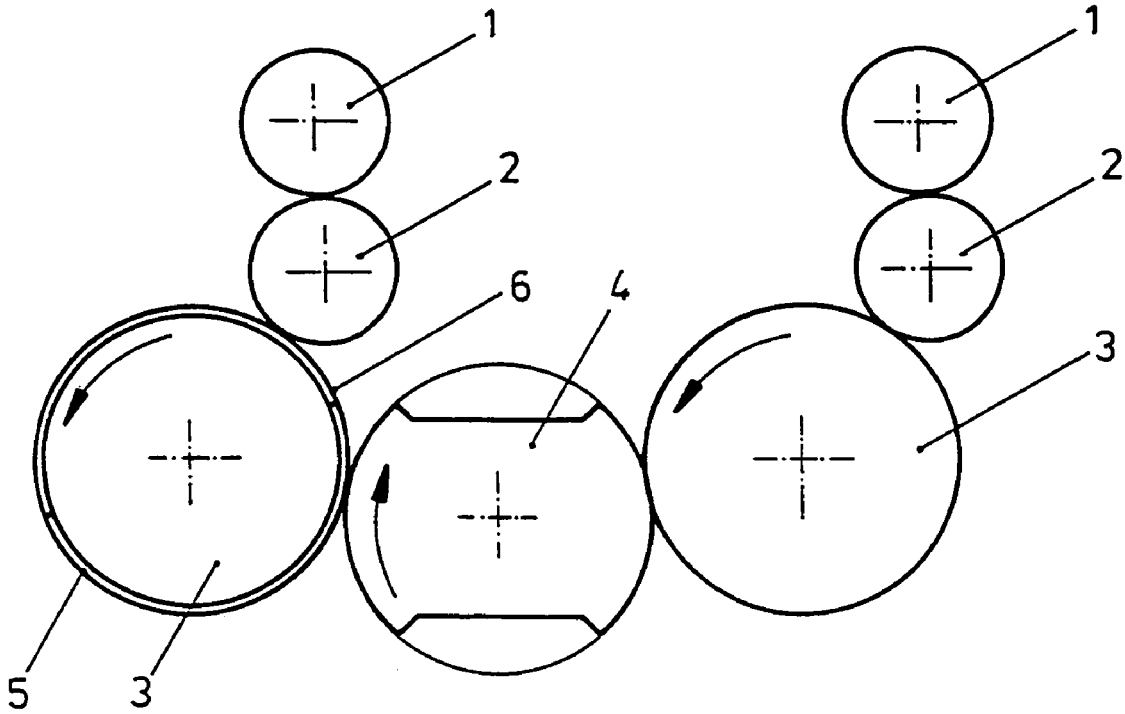

The invention pertains to packing for a sheet-guiding cylinder in a processing machine, in particular, a printing or varnishing machine, according to the preambles of Claims 1 and 2.

STATE OF THE ART

Packings for sheet-guiding cylinders are used in printing machines, particularly in first-side printing machines and second-side printing machines. In first-side and second-side printing machines, after the first side is printed or varnished and the sheet is turned over in order to print or varnish the second (upper) side, the sheet is carried by a sheet-guiding cylinder, for example, a counter-pressure cylinder. This may cause the fresh ink or varnish from the first side of the sheet to be deposited on the cylinder jacket due to ink/varnish transfer. The jacket of the sheet-guiding cylinder must be cleaned so as to not impair the quality of the print images of the subsequent sheets.

A packing of this type is known from DE 28 20 549 A1. The packing is referred to as a sheet-guiding foil and has a two-layer structure. The first layer is a backing foil with depressions on the side that faces the material to be printed, where these depressions are produced by means of a blasting treatment. The second layer is a nickel coating layer that is deposited on the surface roughened by means of the blasting treatment. However, the durability of such a coating is particularly impaired by the wear on the projecting elevations of the surface (relative movement between the material to be printed and the surface of the elevations), and an optimal ink transfer characteristic cannot be achieved in this case.

EP 0 017 776 A1 discloses a packing film in which the surface that comes in contact with the material to be printed is provided with structural elements in the form of spherical segments of identical height which are distributed in a statistically uniform fashion. Such a packing can be manufactured by electroforming a metallic backing foil or by pressing a plastic film with a high modulus of elasticity in order to produce the spherical segments. A cover layer of chrome is then deposited in order to compensate for the microroughness of the surfaces of the spherical segments in the backing foil. However, the thinness of the cover layer limits the service life of the packing.

Another development of a packing is known from DE 42 30 567 A1. In this case, the convex structural elements have an oval shape with a radius of curvature that becomes larger from the top of an elevation to the transition into the convex structure elements.

A single-layer or multi-layer jacket for a sheet-guiding cylinder is known from EP 29 14 255 A1. The jacket has a grease-repellent, wear-resistant outer layer that contains at least 30% nickel and/or chrome. This is supplemented with additional admixtures of the elements molybdenum, tungsten, cobalt, aluminum, boron, manganese, titanium, magnesium and cerium. In one embodiment, a sealing substance, preferably Teflon or copying varnish, is introduced into the pores of this outer layer.

DE 198 50 968 A1 discloses a wear-inhibiting, ink-repellent coating—suitable for printing machine components—that consists of a material of metal oxides or hard metals that are subjected to only little wear. This coating is further treated with a sealing material from the polysiloxane group.

OBJECTIVE OF THE INVENTION

The invention is based on the objective of developing a packing of the initially described type which eliminates the aforementioned disadvantages and, in particular, has a surface with an improved ink transfer characteristic and with noticeably reduced wear.

This objective is realized with the characteristics of Claims 1 and 2. Further developments are disclosed in the dependent claims.

A first advantage is achieved due to the fact that the packing has a special layered structure with an ink/varnish-repellent surface that improves the retransfer of the ink/varnish. The build-up of ink or varnish on the surface of a packing arranged on a sheet-guiding cylinder due to the retransfer is noticeably minimized.

Another advantage is that a significant reduction in the ink release characteristic can be observed when a printed or varnished side of a sheet material is carried by the outer surface of the packing. This leads to a noticeable improvement of the print quality, in particular, when operating in the first-side printing mode and in the second-side printing mode in multicolor printing processes.

It is also advantageous that the packing or packings with the special coating can be rapidly arranged in a detachable fashion on a single- or multi-size sheet-guiding cylinder relative to a single-size form or plate cylinder. This makes it possible to realize short set-up times when the packing or packings of a sheet-guiding cylinder must be exchanged.

Another advantage is that the surface of the packing has a reduced contact surface relative to the printed side of the sheet material. The contact surface is formed by a plurality of irregularly arranged elevations that essentially have the form of cones with rounded tips. The contact surface can be further minimized by means of a preferred structuring of the layer structure.

It is also advantageous that the packing according to the invention can be universally used on sheet-guiding cylinders in processing machines. Sheet-guiding cylinders of this type are used in printing machines (with or without varnishing mechanisms), preferably for multicolor printing processes and in the first-side printing mode and the second-side printing mode, as well as in varnishing machines, preferably multiple varnish applications and in the first-side printing mode and the second-side printing mode.

EXAMPLES

An embodiment of the invention is described in greater detail below.

Shown are

Figure 2:
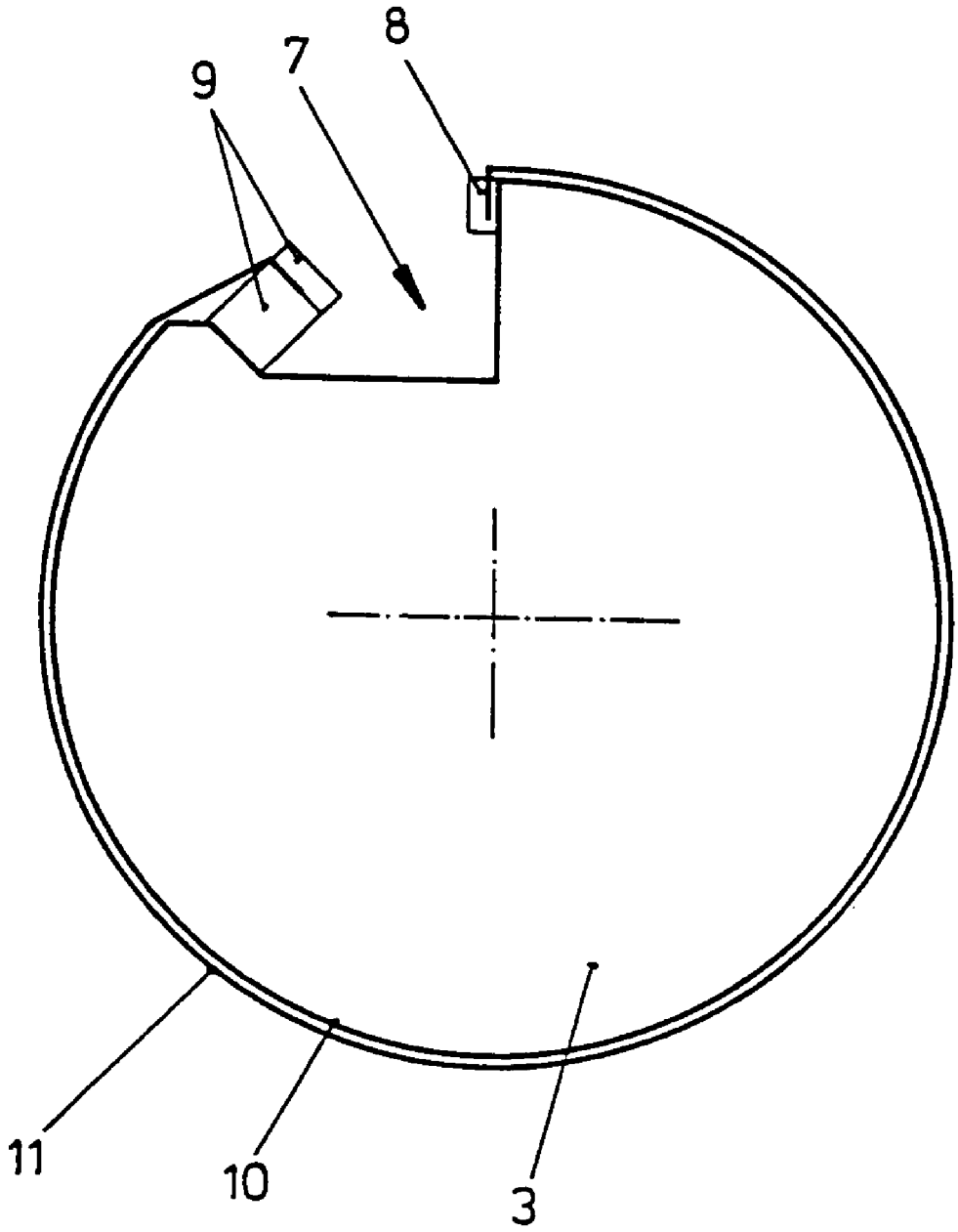
Figure 3:
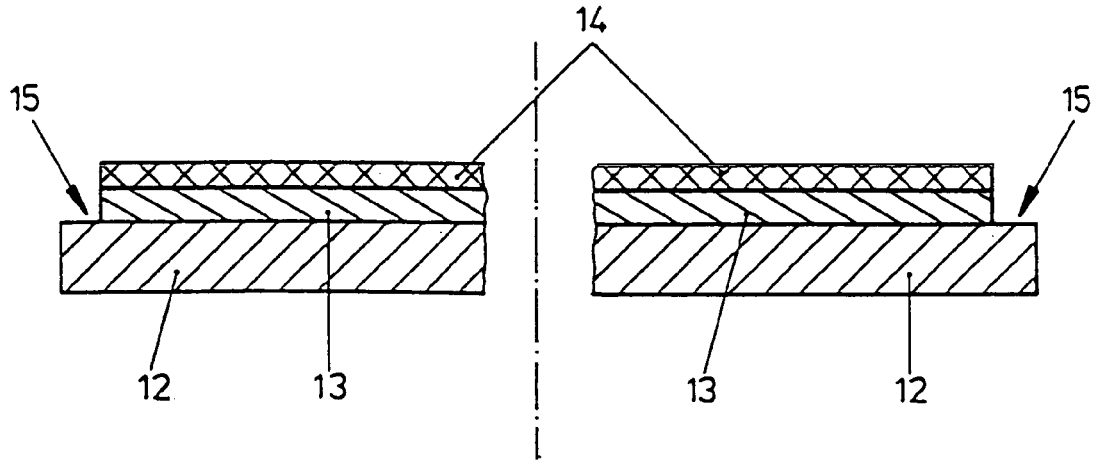

FIG. 1, a sheet-guiding cylinder with packing in a printing machine for the first-side printing mode or the first-side and second-side printing modes;

FIG. 2, the arrangement of a packing on a single-size sheet-guiding cylinder;

FIG. 3, the layer structure of a packing (in the form of a section), and

Figure 4:
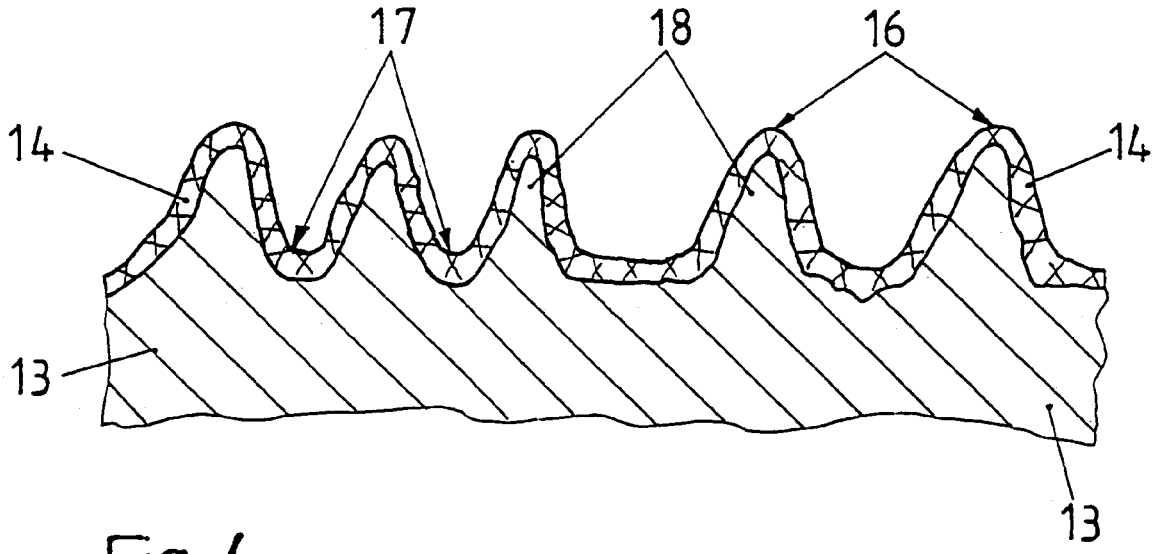

FIG. 4, an (enlarged detail) of the surface profile in the form of a vertical section.

A sheet-fed rotary printing machine contains at least printing mechanisms for multicolor printing processes, wherein said printing machine is preferably also provided with varnishing mechanisms. Each printing mechanism contains a sheet-guiding cylinder that serves as the printing cylinder 3, wherein a rubber blanket cylinder 2 is assigned to the printing cylinder 3 and a plate cylinder 1 is assigned to the rubber blanket cylinder 2. At least one turning drum 4 for the sheet transport to subsequent printing/varnishing mechanisms is arranged, for example, in accordance with the one-drum turning principle or the three-drum turning principle between the printing mechanisms, in particular between the printing cylinders 3 that guide the sheets.

In the embodiment shown (FIG. 1), the turning drum 4 is realized in the form of a double-size drum, supported on the side of the frame and provided with two sheet-retaining systems for the sheet transport in the first-side printing mode or the first-side and second-side printing mode, wherein said sheet-retaining systems are symmetrically arranged on the circumference (offset by 180°).

The double-size printing cylinder 3 arranged downstream of the turning drum 4 relative to the transport direction is respectively provided with a first packing 5 and a second packing 6, wherein said packings are detachably arranged on a surface 10 of the printing cylinder 3 in order to form a curved outer surface 11 for guiding the sheets. The packings 5, 6 are preferably fixed on the printing cylinder 3 by means of clamping elements at the print start 8 and clamping elements at the print end 9 which are arranged in at least one cylinder channel 7. The sheet-retaining systems are preferably arranged in the cylinder channel 7.

The packings 5, 6 are respectively realized in the form of a layered body of identical structure which comprises three layers. The ends of the packings 5, 6, particularly of the backing material 12, respectively contain a region 15, wherein the region 15 serves for fixing the packings 5, 6 in the clamping elements 8, 9.

A backing material 12 (first layer) is flexible and preferably consists of a metal, for example, a stainless special steel, wherein the underside of the backing material is assigned to the surface 10 of the printing cylinder 3. The upper side of the backing material 12 is provided with a coating 13 (second layer) that is adhesively applied to the backing material 12. The coating 13 (second layer) carries a sealing layer 14 (third layer) that is assigned to the material to be printed and adhesively applied to the coating 13.

The coating 13 has a structured surface profile. The layer thickness lies between 10 and 120 μm, and the roughness $R_Z$ lies between 5 and 60 μm.

The coating 13 has an irregular surface profile that consists of randomly distributed elevations in the form of cones (cone 18) with rounded tips 16 so as to achieve the smallest possible contact surface, as well as of valleys 17. Such a surface profile of the coating 13 can be produced during the coating process or subsequently etched into the coating 13. If viewed in the form of a vertical section (FIG. 4), the surface profile of the coating 13 and the sealing layer 14 that is essentially adapted to the contour of the cones 18 are preferably formed by individual and/or interlinked cones 18 that are separated from one another and have rounded tips 16.

In addition, the upper side of the backing material 12 of the packings 5, 6 which faces the material to be printed can be pre-treated before the application of the coating 13, namely by means of blasting, brushing, embossing, engraving, electrical discharge machining, laser treatment or a purely chemical or electrochemical etching method.

The coating 13 consists of metals such as chromium, iron, titanium, nickel, cobalt or tungsten, their oxides such as $Al_2O_3$, $TiO_2$, $Cr_2O_3$, $SiO_2$ or $ZrO_2$, their carbides such as WC or $Cr_3C_2$ or silicides of these metals, mixtures or alloys thereof, e.g., NiCr, and variations thereof.

In one preferred embodiment, the material for the coating 13 consists of pure molybdenum (Mo). This material Mo not only has favorable sliding properties, but is also subjected to substantial strain-hardening under mechanical stress such that an optimally hardened surface of the coating 13 is already achieved after a short operating time.

The sliding properties of the coating 13 of molybdenum can be improved during the operation by forming a very thin molybdenum disulfide ($MoS_2$) layers. These layers are formed by the interaction between the molybdenum and the sulphured components of the inks that are bound with mineral oil. In an alternative embodiment, $MoS_2$ is admixed with the coating powder in a quantity up to 30 vol % such that the superior sliding properties of such a molybdenum layer become immediately effective.

In another embodiment, tungsten carbide/cobalt (WC/Co) is used as the preferred material for the coating 13.

The coating 13 may be directly applied to the backing material 12 or indirectly by means of a bonding agent. The coating 13 is preferably applied to the backing material 12 by means of thermal spraying. In one embodiment, the surface structure of the coating 13 can be subsequently improved by slightly grinding, polishing or stripping the surface.

The ink-repellent properties of the coating 13 can be improved with the sealing layer 14. The sealing layer 14 consists of a material with a low surface energy. According to one preferred embodiment, fluorinated hydrocarbons such as acrylates, as well as fluoric polymers on the basis of PTEF and copolymers containing fluorine, may be used for this purpose. Alternatively, inorganic-organic hydride [sic; hybrid] polymers that are composed of an organic SiSi network and an inorganic Si—O network may be applied to the upper side of the coating 13. Functional groups such as alkyls, vinyls or metal oxides can be dispersed in these hybrid polymers. Alternatively, it would be possible to disperse polysiloxanes, their residual hydrocarbons, preferably methyl groups, as well as other alkyls such as phenyl groups or aryl groups. In addition, halogenated groups, in particular F and F compounds, can be incorporated into these compounds. The adhesiveness and the wear resistance of the sealing layer 14 can be improved by means of a hardening process at temperatures between 50 and 450° C.

In order to improve the wear resistance and the ink/varnish-repellent effect, the sealing layer 14, in particular the polysiloxane, must be exposed to a steam-saturated atmosphere after the manufacture of the layered body (packings 5, 6). A residual crosslinking of free SiH groups takes place at temperatures $t_{max}$=120° C. over a time r<120 min such that the sealing layer 14 is polymerized.

According to another embodiment, migration additives in the form of polydimethylsiloxanes with terminal hydrated groups can be dispersed in the sealing layer 14, particularly when using polysiloxanes. The migration additives preferably are mixed with the sealing substance during the manufacture of the sealing layer 14.

The design of the sheet-guiding cylinder with detachably arranged packings 5, 6 is not limited to a double-size printing cylinder 3. On the contrary, it is possible to realize single-size sheet-guiding cylinders with one base body and one packing 5 or triple-size to quadruple-size sheet-guiding cylinders with three or four packings 5, 6 that are symmetrically arranged on the circumference of the base body, etc. In addition, the invention is not limited to printing cylinders 3, but can also be used for all cylinders that guide sheets, for example, feed drums, transfer drums, winding drums and impression cylinders.

LIST OF REFERENCE SYMBOLS

1 Plate cylinder
2 Rubber blanket cylinder
3 Printing cylinder
4 Turning drum
5 First packing
6 Second packing
7 Cylinder channel
8 Clamping element (print start)
9 Clamping element (print end)
10 Surface
11 Outer surface
12 Backing material
13 Coating
14 Sealing layer
15 Region
16 Rounded tip
17 Valley
18 Cone

The invention claimed is:

1. A multicolor printing machine comprising sheet guiding cylinders over which sheets are directed during a printing and/or varnishing operation, said sheet guiding cylinders each comprising a cylindrical body with at least one sheet retaining system arranged thereon, at least one of said sheet guiding cylinders having a packing (5, 6) detachably supported thereon, said packing (5, 6) having a multilayered structure including a flexible backing material (12) supported on the body of the sheet guiding cylinder;

a coating (13) having an irregular surface profile adhesively supported on an upper surface of the backing material (12), said coating (13) being made of a hard metal that forms a surface with sliding properties; and a sealing layer (14) adhesively secured on an upper side of the coating (13) made of a material selected from the group consisting of polysiloxane, acrylate, or fluoric polymers.

2. The printing machine of claim 1 in which said coating (13) is made of molybdenum.

3. The printing machine of claim 1 in which said coating (13) is made of a metal alloy of corrosion-proof and wear resistant metal.

4. The printing machine of claim 3 in which said coating is made of NiCr.

5. The printing machine of claim 1 in which an outer side of the packing (5, 6) which faces and supports material to be printed has a surface profile consisting of cones (18) with rounded tips (16).

6. The printing machine of claim 1 in which the sealing layer (14) is made of a polysiloxane that is polymerized in a steam-saturated atomosphere.

7. The printing machine of claim 1 in which said sealing layer (14) contains migration additives in the form of polydimethylsiloxanes.

8. The printing machine of claim 1 in which said coating (13) contains up to 30% by vol $MoS_2$.

9. A multicolor printing machine comprising sheet guiding cylinders over which sheets are directed during a printing and/or varnishing operation, said sheet guiding cylinders each comprising a cylindrical body with at least one sheet retaining system arranged thereon, at least one of said sheet guiding cylinders having a packing (5, 6) detachably supported thereon, said packing (5, 6) having a multilayered structure including a flexible backing material (12), the underside of which is assigned to the body of the sheet-guiding cylinder (3), a coating (13) of molybdenum adhesively arranged on the upper side of the backing material (12), and a sealing layer (14) of a material of the polysiloxane group adhesively arranged on the upper side of the coating (13).

10. The printing machine of claim 9 in which an outer side of the packing (5, 6) which faces and supports material to be printed has a surface profile consisting of cones (18) with rounded tips (16).

11. A multicolor printing machine comprising sheet guiding cylinders over which sheets are directed during a printing and/or varnishing operation, said sheet guiding cylinders each comprising a cylindrical body with at least one sheet retaining system arranged thereon, at least one of said sheet guiding cylinders having a packing (5, 6) detachably supported thereon, said packing (5, 6) having a multilayered structure including a flexible backing material (12), the underside of which is assigned to the body of the sheet-guiding cylinder (3), a coating (13) having an irregular surface profile made of tungsten carbide/cobalt adhesively arranged on the upper side of the backing material (12), and a sealing layer (14) of a material of the polysiloxane group adhesively arranged on the upper side of the coating (13).

12. The printing machine of claim 11 in which an outer side of the packing (5, 6) which faces and supports material to be printed has a surface profile consisting of cones (18) with rounded tips (16).

* * * * *